United States Patent [19]

Keller

[11] 4,168,730

[45] Sep. 25, 1979

[54] APPARATUS AND METHODS FOR FORMING DOVETAIL JOINTS

[76] Inventor: David A. Keller, 140 Bolinas Olema Rd., Bolinas, Calif. 94924

[21] Appl. No.: 866,258

[22] Filed: Jan. 3, 1978

[51] Int. Cl.[2] ..... B27C 5/10

[52] U.S. Cl. ..... 144/326 R; 144/87; 144/144 R; 144/144.5 R; 144/323

[58] Field of Search ..... 144/85, 87, 90 R, 90 A, 144/134 R, 136 R, 137, 144 R, 144.5, 145 C, 150, 321, 323, 326 R

[56] References Cited

U.S. PATENT DOCUMENTS

| | | | |
|---|---|---|---|
| 463,861 | 11/1891 | Gilliland . | |
| 1,651,510 | 12/1927 | Carter | 144/87 |
| 1,751,816 | 3/1930 | Hunter | 144/144.5 |
| 2,764,191 | 9/1956 | Hartmann | 144/87 |
| 3,057,383 | 10/1962 | Waite | 144/85 |
| 3,223,132 | 12/1965 | Erne | 144/87 |
| 3,332,462 | 7/1967 | Williams . | |
| 3,547,171 | 12/1970 | Jacumin . | |
| 3,878,875 | 4/1975 | McCord, Jr. | 144/87 |

FOREIGN PATENT DOCUMENTS

| | | | |
|---|---|---|---|
| 606944 | 3/1926 | France | 144/87 |
| 259290 | 10/1926 | United Kingdom | 144/87 |

OTHER PUBLICATIONS

Rockwell International Catalog; "Router/Trimmer Accessories", p. 73.

Stanley Tool Company Catalog; "Stanley Router Accessories", p. 29.

*Primary Examiner*—Robert Louis Spruill
*Assistant Examiner*—W. D. Bray

[57] ABSTRACT

Disclosed is a tool set for forming dovetail joints including elongated dovetail and pin template plates and dovetail and pin bits. The dovetail plate has a plurality of laterally-extending slots opening through a long edge of the plate, the slots having opposed parallel edges. The dovetail and pin bits are each provided with a bearing about their respective shanks. The elongated pin template plate has a plurality of longitudinally spaced openings each having opposed edges angled to converge toward one another at the same angle as the angle of the cutter of the dovetail bit. To form a dovetail joint using the kit, the dovetail template is disposed over the end edge of a joint member and the dovetail bit is passed through each slot with its bearing engaging the opposed edges of the slot to guide the bit whereby through dovetails are cut in the end of the joint member. The dovetailed member is then disposed over the end edge of the adjoining member and the pin locations are scribed onto its end edge. The pin template is then located over the scribed edge and the angled edges of its openings are aligned with the scribed lines. The pin template bit is inserted into the opening and the pins are cut, the bearing on the pin bit shank engaging along the edges of the openings to accurately guide the pin bit.

11 Claims, 9 Drawing Figures

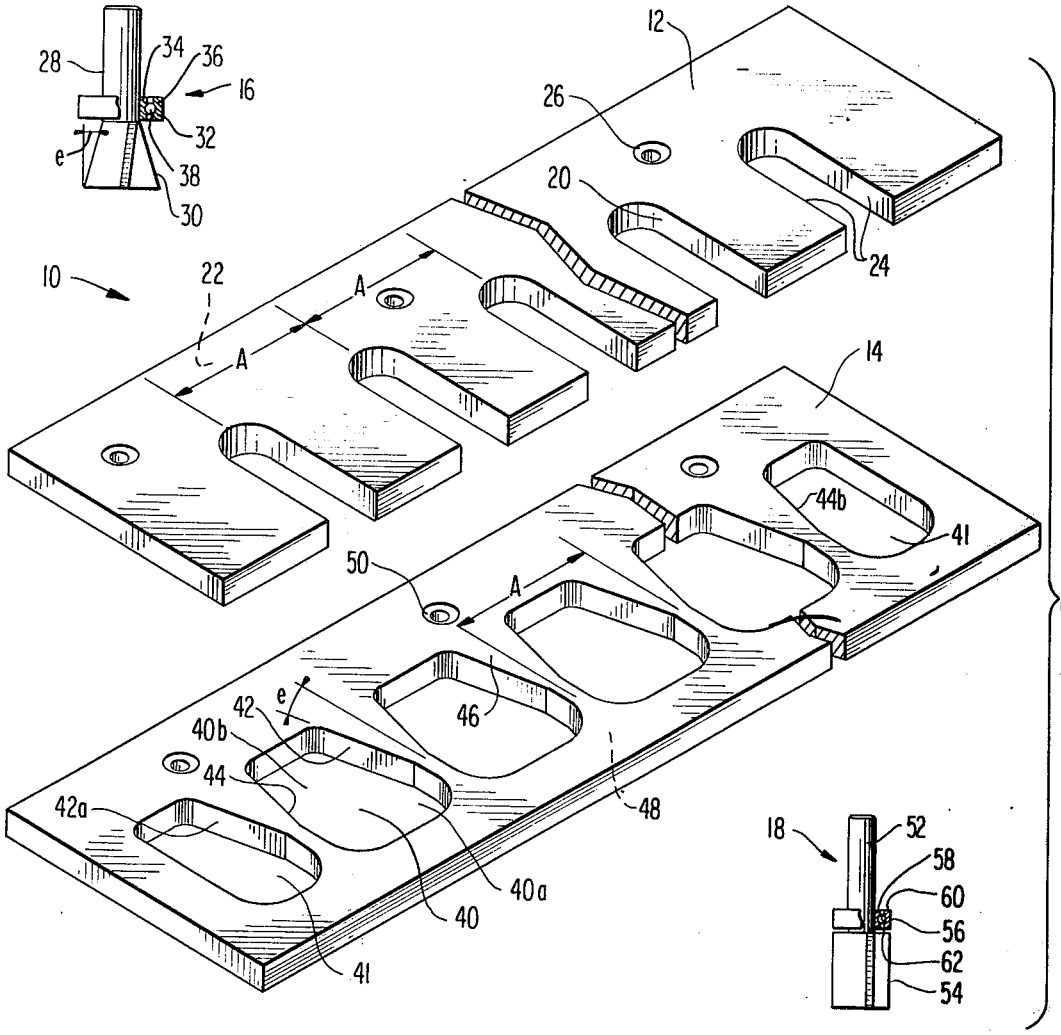
FIG 1
FIG 2
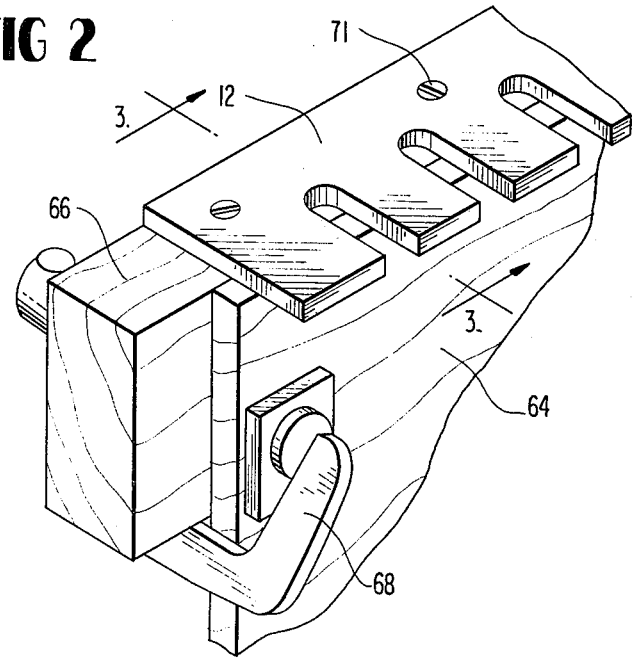
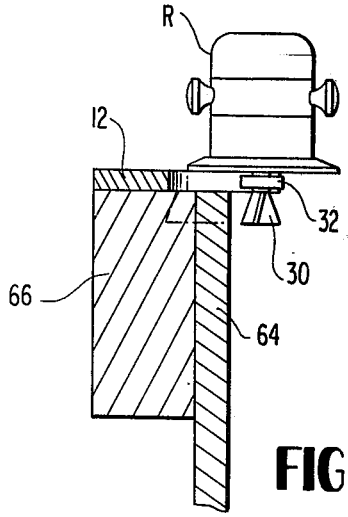
FIG 3

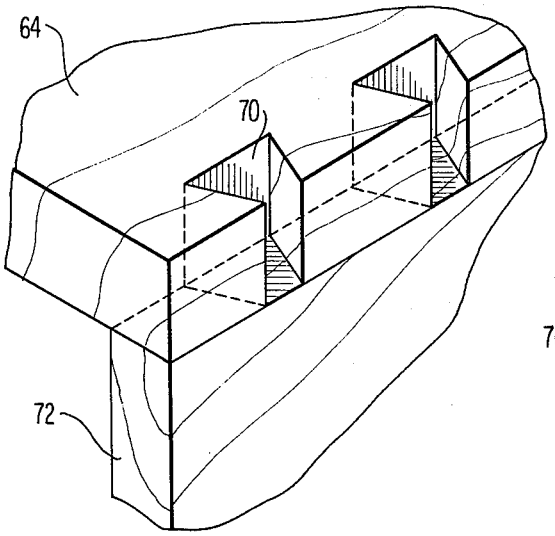
FIG 4
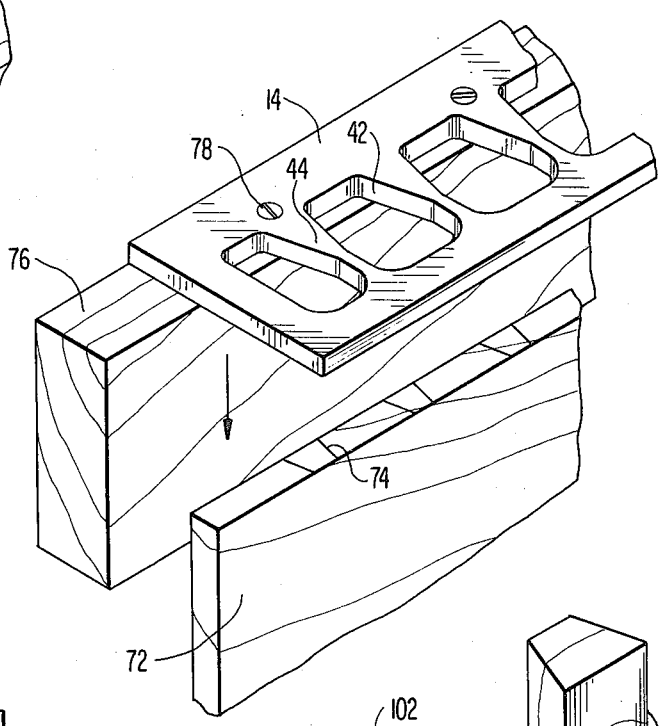
FIG 5
FIG 6
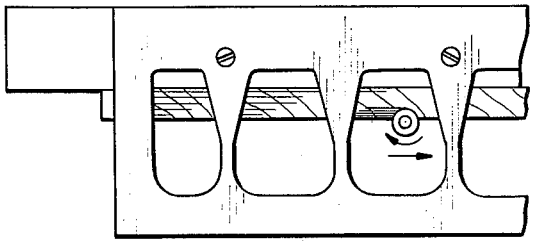
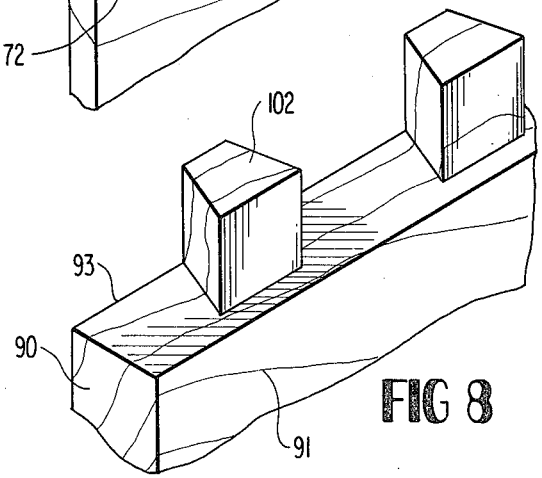
FIG 8
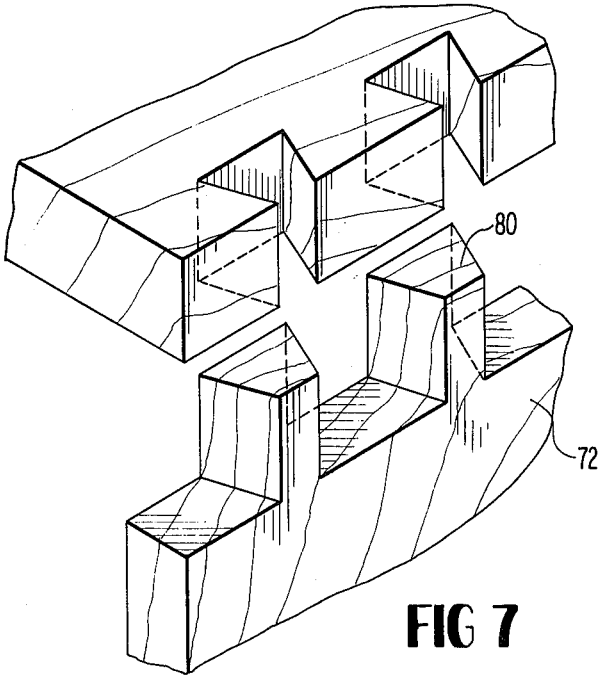
FIG 7
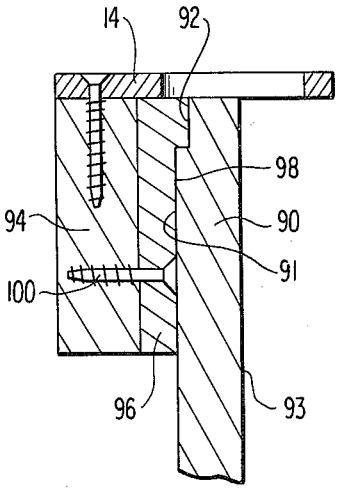
FIG 9

APPARATUS AND METHODS FOR FORMING DOVETAIL JOINTS

The present invention relates to apparatus and methods for forming dovetail joints and particularly relates to a kit or tool set useful for forming dovetail joints and to a method for forming such joints.

Dovetail joints between perpendicularly disposed adjoining wooden members are, of course, well known in the furniture construction industry and are of course commonly used in the formation of furniture drawers, small boxes, and the like. A wide variety of apparatus and methods for forming such dovetail joints are also of course well known. Through dovetail and blind dovetail joints are likewise well known and are conventionally and commercially formed by utilizing commercially available tools. However, the formation of through dovetail joints by the amateur carpenter or the precision woodworking craftsman using hand-held power tools, particularly when forming dovetail joints for furniture of substantial size, such as large chests, cabinets and the like, has heretofore proven extremely difficult. One principal reason is that the available templates are simply not of sufficient size or length for the formation of dovetail joints in the larger pieces. As significant is the fact that such carpenter or craftsman usually employs a router and available guide templates which have serious inherent disadvantages. For example, the guide mounted on the base of the router for guiding the bit through the work is not usually so accurately positioned as to maintain a concentricity of the axis of rotation of the router bit relative to the guide. That is, as the router's angular position is changed as it is moved along the template, the distance between the cutting circle circumscribed by the cutter and the template edge or guide oftentimes changes. As a consequence, the wood removed by the bit at any given location varies and is a function of the angular position of the router and base mounted guide relative to the template. This introduces a variable inaccuracy in the formation of both dovetails and pins. The resulting joints are often incapable of being meshed together or are frequently too loose.

Accordingly, it is a primary object of the present invention to provide novel and improved apparatus and methods for forming dovetail joints.

It is another object of the present invention to provide apparatus in the form of a kit or tool set for forming dovetail wooden joints.

It is another object of the present invention to provide novel and improved apparatus and methods for forming dovetail joints wherein extreme accuracy and repeatability of the cuts are achieved with consequent precision in the joints formed between the adjoining members.

It is still another object of the present invention to provide novel and improved apparatus and methods for forming dovetail joints which require a minimum of set-up time and minimizes or eliminates the clean up or finalization of the joint parts prior to assembly of the joint.

It is a further object of the present invention to provide novel and improved apparatus and methods for forming dovetail joints wherein the accuracy of the joint is ensured by correlating the dovetail and pin templates one to the other and to the workpieces in such a manner that formation of the pins is precisely complementary to the formation of the dovetails.

It is a still further object of the present invention to provide a novel and improved apparatus for forming dovetail joints in a tool set or kit form for ready and easy use by both amateur carpenters and precision woodworking craftsman.

It is a still further object of the present invention to provide novel and improved apparatus and methods for forming dovetail joints wherein the dovetail and pin templates are designed to minimize or eliminate the tendency of the power router to tip relative to the template and/or work and thus eliminate inaccurate or imprecise cuttings.

It is a related object of the present invention to provide novel and improved apparatus and methods for forming dovetail joints including novel dovetail and pin bits having attached bearings for guiding the bits for each pass of the bit through a slot or opening in the respective templates.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the foregoing objects and in accordance with the purpose of the present invention, as embodied and broadly described herein, the kit or tool set hereof for forming dovetail joints in adjoining wooden members includes a dovetail template formed of an elongated plate having a plurality of slots spaced longitudinally one from the other along the plate for overlying the end edge of one of the joint members, the slots opening along a long edge of the plate, a dovetail bit having a shank for securement to a power tool and a dovetail cutter having a predetermined cutting angle, a bearing rotatably carried by the shank for engaging the edges of the dovetail template slots to guide the dovetail bit upon passing it through the slots and the dovetail cutter through the one joint member from one side to the other, a pin template including an elongated plate having a plurality of openings for overlying the end edge of the other joint member, each of the openings being defined by opposed side edges convergent one toward the other in a transverse direction at angles corresponding to the cutting angle of the dovetail cutter, a pin bit having a shank for securement to a power tool and a pin cutter, and a bearing rotatably carried by the shank of the pin bit for engaging the edges of the pin template openings to guide the pin bit upon passing it and the pin cutter through the other joint member from one side to the other.

Preferably, the dovetail bit bearing diameter is only slightly less than the width of each slot in the dovetail template to enable the bearing to move lengthwise along the slots without substantial movement of the bit laterally within the slots. Also, the slots and openings in the respective dovetail and pin templates lie on centerlines spaced equally along their respective lengths with the centerline to centerline distance between each of the adjacent slots in the dovetail template being equal to the centerline to centerline distance between each of the adjacent openings in the pin template.

Also in accordance with the foregoing objects and purposes of the present invention, a method of forming dovetail joints in adjoining members in accordance with the present invention includes disposing the dovetail template over the end edge of one of the adjoining members, passing the dovetail bit into each slot to cut dovetails in the end of the one member, engaging the bit bearing against the opposed edges of each dovetail template slot to guide the bit for each passing of the dovetail bit along each slot, disposing the end of one member over the end edge of the other member to register the dovetails with the end edge of the other member, scribing the outline of the dovetails on the end edge of the other member, disposing the pin template over the end edge of the other member, aligning the convergent edges of the openings in the pin template with the lines scribed on the end edge of the other member, passing the pin bit into each opening and cutting through the areas of the other member exposed in the openings to form pins, and engaging the bit along the edges of the openings in the pin template to guide the pin bit when cutting through such exposed areas of the other member.

The accompanying drawings, which are incorporated in and constitute a part of this specification, illustrate two embodiments of the present invention and, together with the description, serve to explain the principles of the invention.

In the Drawings:

FIG. 1 is an exploded fragmentary perspective view of a tool set or kit constructed in accordance with the present invention and useful for forming dovetail joints;

FIG. 2 is a fragmentary perspective view illustrating application of the dovetail template to the work;

FIG. 3 is a cross-sectional view taken generally about the lines 3—3 in FIG. 2 illustrating the application of a power router to the template and work in the formation of the dovetails;

FIG. 4 is an enlarged fragmentary view illustrating the application of the work in which dovetails have been formed along the end of the other joint member to enable the configuration of the dovetails to be scribed on the end of the other joint member;

FIG. 5 is an exploded fragmentary perspective view illustrating the application of the pin template to the other joint member prior to forming the pins;

FIG. 6 is a plan view of the apparatus illustrated in FIG. 5 and further illustrating the pin bit in use to cut away material between the pins to be formed;

FIG. 7 is an enlarged fragmentary exploded view of the joint members illustrating the dovetails and pins formed by using the tool set or kit constructed in accordance with the present invention and prior to the formation of the joint;

FIG. 8 is a fragmentary perspective view of another embodiment of the present invention wherein the joint members have a thickness greater than the depth of the dovetail cut; and FIG. 9 is a cross-sectional view through a set-up for utilizing the pin template in connection with the formation of a joint wherein the joint members have a thickness greater than the depth of the dovetail cutter.

Referring now to FIG. 1, elements comprising the tool set or kit, generally designated 10, for forming dovetail joints in accordance with the apparatus and methods of the present invention are illustrated. These elements include a dovetail template 12, a pin template 14, a dovetail bit, generally designated 16, and a pin bit, generally designated 18. Dovetail template 12 includes an elongated plate, preferably formed of aluminum, having a plurality of longitudinally-spaced, transversely extending, slots 20 which open laterally or to one side of elongated plate 12. The centerlines of slots 20 are designated 22 and the centerline to centerline distance between adjacent slots, designated A, is equal each to the other.

The opposed edges 24 of each slot 20 are parallel one to the other and perpendicular to the longitudinal extent of plate 12. Plate 12 also has a plurality of countersunk holes 26 longitudinally spaced one from the other along the plate for receiving screws, preferably flathead screws, whereby template 12 can be fixed to a backing piece when in use as described hereinafter.

In accordance with the present invention, the dovetail bit 16 employed with the dovetail template 12 includes a shank 28 for securement in the collet of a power tool, for example a router R (FIG. 3), a dovetail cutter or blade 30 having a predetermined angle of cut indicated e, and a bearing 32. Bearing 32 comprises inner and outer races 34 and 36 respectively, separated by a plurality of balls 38 in a carrier, not shown. Inner race 34 is preferably secured to shank 28 by an epoxy whereby the shank 28, cutter 30, and inner race 34 on the one hand and outer race 36 on the other hand are relatively rotatable one to the other. While it is preferred that the bearing is secured to the shank by an epoxy, a snap-type fit could be employed whereby the bearing is removable from bit 16 and can be useful with other bits, for example, dovetail bits of different sizes.

Pin template 14 comprises an elongated metal plate preferably formed of aluminum having a plurality of openings 40 spaced longitudinally one from the other along the plate. Each opening is completely enclosed or surrounded by the material of the template and includes a pair of opposed edges 42 and 44 which converge or angle one toward the other and toward one side of the plate. The angle of convergence relative to a direction perpendicular to the length of the plate is identical to the angle of cut e of router bit 16 for reasons discussed hereinafter. With the exception of the end openings 41, each opening 40 is thus shaped to include an enlarged base portion **40*a* which narrows down to a reduced end portion 40*b* at the opposite end of the opening. The end openings 41 are reduced in width relative to the intermediate openings with single angled sides 42*a* and 44*a*** respectively along their interior edges.

The transverse centerlines, not shown, of openings 40 are equally spaced one from the other along the length of the plate. Likewise, the transverse centerlines, designated 48 of the material 46 between each of the openings 40 are spaced equally one from the other along the length of the plate. More particularly, centerlines 48 are spaced a longitudinal distance A one from the other corresponding to the longitudinal distance A between the centerlines of the slots of the dovetail template 12. As in dovetail template 12, pin template 14 includes a plurality of countersunk openings 50 whereby it can be secured to backing pieces when in use as explained hereinafter.

The pin bit 18 includes a shank 52, a straight cutter 54 and a bearing 56. As in bearing 32, bearing 56 includes inner and outer races 58 and 60, respectively, separated by a plurality of balls 62 and a retainer, not illustrated. Bearing 56 is permanently secured to shank 52 by an epoxy although may be releasably secured to shank 52, for example by a snap fit, as desired. Consequently, it will be appreciated that shank 52, cutter 54, and inner race 58 on the one hand and outer race 56 on the other hand are rotatable relative to one another for reasons which will become apparent from the ensuing description.

To employ the tool kit of the present invention and referring particularly to FIG. 2, one end of a member 64 of the dovetail joint to be formed is clamped to a backing piece 66, for example by a C-clamp 68. Dovetail template 12 is then secured to backing piece 66 by flathead screws 71 received through openings 26, the slots 24 overlying the end edge of the member 64 when template 12 is in final position. It is important that the opposed parallel edges 24 of slots 20 completely overlie the full width of the end edge of member 64 to enable dovetail bit 16 to make a complete pass through the full width of member 64. Dovetail bit 16 is then secured to the power router, in the usual manner, and the cutter 30 set to a depth below the router base a distance slightly in excess of the template thickness. When the router base is disposed on the template as illustrated in FIG. 3 bearing 32 will therefore lie below the router base in lateral alignment with the template and the cutter 30 will lie below template 12 in lateral alignment with the edge of the member 64 in which dovetails are to be cut as illustrated in FIG. 3.

With the router base flat on the template, the router is moved to pass the bit through each slot of the template to form the dovetails in the end of member 64. In passing the bit through the slots of the template 12, bearing 32 engages along the opposite sides 24 of each slot and this coaction with the template accurately guides the router and bit to cut only the areas desired in the end of member 64. Bearing 32 is sized to have a diameter substantially equal to or slightly less than the width of the slot to insure accuracy of the cut by preventing substantial lateral movement of the bit within the slot as the bit traverses the length of the slot. Further, by utilizing a bearing in the router bit shank, the concentricity of the cut and the axis of rotation of the bit is maintained for all angular positions of the router. It will also be appreciated that the flat base of the router rides on the flat upper surface of the template. A substantial surface area on the template against which the router base bears is thus provided which eliminates or minimizes any tendency of the router to tilt relative to the template.

Once the dovetails are formed in the end of member 64, for example the dovetails indicated 70 in FIG. 4, the end edge of member 64 is located to overlie the end edge of the adjoining member 72. The location of the dovetails 70 are then scribed onto the end edge or face of member 72 as indicated at 74 in FIG. 5. Pin template 14 is then located to overlie the end edge of member 72 and the angled or convergent edges 42 and 44 of openings 40 are aligned with the scribe lines 74. Member 72 is then clamped to a backing member 76 and pin template 14 is also secured to member 76 by screws 78 extending through openings 50. Pin bit 18 is also secured to router R in such manner that cutter 54 is disposed a distance below the base of router R slightly greater than the thickness of the pin template 14. When the pin bit is inserted into each opening 40 and end openings 41 and the flat router base is disposed on template 14, bearing 56 is thus laterally aligned with pin template 14. The area of the member 72 exposed through openings 40 and 41 is then cut away to a depth equal to the depth of cutter 54. By removing only the material of member 72 exposed through openings 40 and 41, the material left in the end of member 72 underlying the template material 46 between these openings defines the pins 80 as illustrated in FIG. 7. Since openings 40 and 41 are fully enclosed or circumscribed by template 14, template 14 provides a large base on which the router can be disposed thus preventing or minimizing any tendency of the router to tilt relative to the template. Also, the bearing 56 engages along the edges 42 and 44 when the exposed material of member 72 is removed and this ensures accuracy and repeatability of the cuts. With the ends of the adjoining members 64 and 72 thus provided with dovetails and pins, respectively, the joint can be effected in the conventional manner.

Referring now to the embodiment illustrated in FIGS. 8 and 9, the kit or tool set hereof is also useful for forming the dovetails and pins where the stock members forming the joint have a thickness in excess of the depth of cut of the cutter of the dovetail bit. To form the dovetail joint under this condition, the dovetails are formed in one of the joint members as previously described. However, it is necessary to step the pins in the other joint member as illustrated in FIG. 8.

To accomplish this, the inside face 91 of joint member 90 is rabbeted to a depth such that the remaining depth of the board is equal to the depth of cut of the dovetail bit cutter. An example of this rabbet cut is illustrated in member 90 at 92 in FIG. 9. A variation in the backing piece is required, however, to enable the rabbeted member 90 to be disposed in proper cutting position relative to the template 14. To accomplish this, a large backing piece 94 and a facing board 96 are provided, the facing board 96 having a face 98 cut to correspond or complement the rabbet cut of member 90. The facing board 96 is secured to backing piece 94 by screws 100. The template 14 is also secured to the backing piece 94 similarly as previously described. The pins are then formed by removing the material in the end of member 90 exposed through openings 40 and 41. By utilizing the initial rabbet cut, the pins 102 will be stepped back from the inside face 91 of member 90. The dovetails of the adjoining member thus receive pins 102 in a manner ensuring that the end edge of the adjoining member lies flush with the outside face 93 of board 90.

In a preferred embodiment for making one inch dovetails to a depth of $\frac{7}{8}$ inch, a $36\times5$ inch dovetail template is provided formed from $\frac{1}{2}$ inch 6061 aluminum. Eleven slots on 3 inch centers are formed along the length of the template with each slot having a width of $1\frac{1}{8}$ inches. Bearing 32 is provided with a diameter equal to or slightly less than $1\frac{1}{8}$ inches to ensure guiding engagement along the slot edges as the bit is passed through each slot. For use with the dovetail template of those dimensions, a $36\times6$ inch pin template is provided and is also formed from $\frac{1}{2}$ inch 6061 aluminum. Ten openings 40 on 3 inch centers and two end openings 41 are provided. Openings 40 and 41 are $3\frac{1}{4}$ inches long with their narrow edges spaced $1\frac{3}{4}$ inch from a long edge of the plate. The enlarged and reduced radii at the respective wide and narrow ends of the openings are $\frac{3}{4}$ and $\frac{1}{4}$ inch respectively. Adjacent edges 42 and 44 of adjoining openings are spaced 1 inch apart along a longitudinally extending reference line spaced $\frac{1}{2}$ inch from the narrow edge of the opening. This ensures a through cut by the pin bit, the latter having a $\frac{3}{4}$ inch bearing 56 and a 0.745 inch diameter cutter.

Thus, it will be appreciated that the objects of the present invention are fully accomplished in that there has been provided a kit or tool set for forming dovetail joints which insures accurate and repeatable dovetails and pins, particularly useful for large furniture and cabinet construction. Moreover, the bearing mounted on each router bit ensures accurate placement of the rotational axis of the bit from the guiding edge of the template for all angular orientations of the router thus ensuring precision cuts and repeatability of precision cuts.

It will be apparent to those skilled in the art that various modifications and variations could be made in the invention without departing from the scope or spirit of the invention.

What is claimed is:

1. A tool kit for forming a dovetail joint in adjoining members comprising:

a dovetail template including an elongated plate having a plurality of slots spaced longitudinally one from the other along said plate for overlying the end edge of one of the joint members, said slots opening along a long edge of said plate, a dovetail bit having a shank for securement to a power tool and a dovetail cutter having a predetermined cutting angle, a bearing rotatably carried by said shank for engaging the edges of the dovetail template slots to guide said dovetail bit upon passing it therealong and the dovetail cutter through the one joint member from one side to the other, a pin template including an elongated plate having a plurality of openings for overlying the end edge of the other joint member, each of said openings being defined by opposed side edges convergent one toward the other in a transverse direction, each said side edge forming an angle with a transverse plane through said pin template which is substantially equal to said cutting angle of the dovetail cutter, a pin bit having a shank for securement to a power tool and a pin cutter, and a bearing rotatably carried by the shank of said pin bit for engaging the edges of the pin template openings to guide said pin bit upon passing it therealong and said pin cutter through the other joint member from one side to the other.

2. A kit according to claim 1 wherein said dovetail bit bearing diameter is only slightly less than the width of each said slot to enable the bearing to move lengthwise along the slots without substantial movement of the bit laterally within the slots.

3. A kit according to claim 1 wherein said pin template openings comprise openings through the pin template completely surrounded by the template.

4. A kit according to claim 1 wherein said dovetail bit bearing comprises inner and outer races, a plurality of balls between said inner and outer races, and means for securing said inner race to the dovetail bit shank.

5. A kit according to claim 1 wherein said pin bit bearing comprises inner and outer races, a plurality of balls between said inner and outer races, and means for securing said inner race to the pin bit shank.

6. A kit according to claim 1 wherein said slots and said openings lie on centerlines spaced equally along the length of the respective plates, the centerline to centerline distance between each of the adjacent slots in the dovetail template being equal to the centerline to centerline distance between each of the adjacent openings in the pin template.

7. A kit according to claim 1 wherein said dovetail bit bearing diameter is only slightly less than the width of each slot to enable the bearing to move lengthwise along the slots without substantial movement of the bit laterally within the slots, the pin template openings comprising openings through the pin template completely surrounded by the template.

8. A kit according to claim 7 wherein said dovetail bit bearing comprises inner and outer races, a plurality of balls between said inner and outer races, means for securing said inner race to the dovetail bit shank, said pin bit bearing comprising inner and outer races, a plurality of ball bearings between said inner and outer races and means for securing said inner race to the pin bit shank.

9. A kit according to claim 8 wherein said slots and said openings lie on centerlines spaced equally along the length of the respective plates, the centerline to centerline distance between each of the adjacent slots in the dovetail template being equal to the centerline to centerline distance between each of the adjacent openings in the pin template.

10. A kit according to claim 1, wherein said pin cutter is straight and has a diameter substantially equal to the diameter of the bearing carried by the shank of said pin bit.

11. A method of forming dovetail joints in adjoining members using elongated dovetail and pin templates, and dovetail and pin bits each having a bearing and a cutter, the dovetail template having a plurality of longitudinally spaced, laterally opening slots with parallel guide edges and the pin template having a plurality of longitudinally spaced openings with opposed edges of each opening being convergent one toward the other comprising the steps of:

disposing the dovetail template over the end edge of one of the adjoining members, passing the dovetail bit into each slot to cut dovetails in the end of the one member, engaging the bit bearing against the opposed edges of each slot to guide the bit for each passing thereof along such slot, disposing the end of the one member over the end edge of the other member to register the dovetails with the end edge of the other member, scribing the outline of the dovetails on the end edge of the other member, disposing the pin template over the end edge of the other member, aligning the convergent edges of the openings in the pin template with the lines scribed on the end edge of the other member, passing the pin bit into each opening and cutting through the areas of the other member exposed in said openings to form pins, and engaging the bit bearing along the edges of the openings in the pin template to guide the pin bit when cutting through such exposed areas of the other member.

* * * * *